United States Patent [19]

Steingass

[11] Patent Number: 4,653,693

[45] Date of Patent: Mar. 31, 1987

[54] FIRE FIGHTING FOG NOZZLE

[75] Inventor: Robert W. Steingass, Valparaiso, Ind.

[73] Assignee: Task Force Tips Incorporated, Valparaiso, Ind.

[21] Appl. No.: 644,266

[22] Filed: Aug. 27, 1984

[51] Int. Cl.[4] ..... B05B 1/26

[52] U.S. Cl. ..... 239/460; 239/456; 239/DIG. 7

[58] Field of Search ..... 239/451, 456–461, 239/498, 522, DIG. 7

[56] References Cited

U.S. PATENT DOCUMENTS

| | | | |
|---|---|---|---|
| 2,936,960 | 5/1960 | Thompson | 239/458 |
| 2,991,016 | 7/1961 | Allenbaugh, Jr. | 239/458 |
| 3,741,481 | 6/1973 | Bauer | 239/102 |
| 4,176,794 | 12/1979 | Allenbaugh | 239/458 X |
| 4,470,549 | 9/1984 | McMillan et al. | 239/583 |

FOREIGN PATENT DOCUMENTS

| | | | |
|---|---|---|---|
| 493723 | 6/1953 | Canada | 239/DIG. 7 |
| 398708 | 9/1933 | United Kingdom | 239/456 |

*Primary Examiner*—Joseph F. Peters, Jr.
*Assistant Examiner*—Michael J. Forman
*Attorney, Agent, or Firm*—Marshall, O'Toole, Gerstein, Murray & Bicknell

[57] ABSTRACT

A peripheral jet fire fighting fog nozzle having mounted on the discharge end thereof a stream-shaping sleeve provided with a convex end face adapted to form an open outer cone-like spray pattern and a plurality of circumferentially spaced fog teeth extending axially from the convex end face with axially extending convex lateral surfaces on the teeth adapted to spread the spray pattern laterally and fill in the lateral opening or gaps in the outer spray pattern. Rounded axially extending inner end surfaces provided on the fog teeth together with adjacent lateral surfaces of the fog teeth are adapted to form uniform droplets which are uniformly distributed within the interior of the outer conical spray pattern to form a uniform conical spray pattern which has a wide angle of divergence and is free of circumferential gaps.

9 Claims, 6 Drawing Figures

2
2
10
12
13
14
15
16
17
18
19
25
26
27
28
30
31
32
33
34
35
36

FIRE FIGHTING FOG NOZZLE

The invention relates generally to a fire fighting nozzle producing fog spray and, more particularly, to a peripheral jet fire hose nozzle which produces a fog spray pattern with substantially uniform droplets distributed uniformly throughout a dispersed conical spray pattern having a wide angle of divergence.

PRIOR ART

Fire fighting nozzles that produce a dispersed spray pattern are often referred to as fog nozzles. Fog nozzles for many years have been an important aid in fighting fires by protecting fire fighters from radiant heat, reducing the temperature of a blaze, limiting the amount of oxygen within an enclosed area, and displacing large quantities of combustible gas from a confined area.

Fog nozzles which produce a dispersed spray pattern having a wide variety of structures, but the peripheral jet fire nozzle is most commonly used, because it has the ability to discharge a straight stream in one position of adjustment and a fog spray in another position of adjustment. In the peripheral jet nozzle one common means for producing fog spray comprises providing a row of equally spaced fixed teeth having a flat face in a circular ring at the discharge end of the nozzle in the path of a conical jet of water issuing from the interior of the nozzle. However, when the water strikes the face of each tooth, it deflects along the same line as the face of the tooth and the spray pattern consists of a conical row of small spaced jets. There is a gap in the outer conical spray pattern for every tooth. Likewise, there is a gap in the inner spray pattern between each jet of water. The characteristic "fingers" in the spray pattern are objectionable, because they permit radiant heat to pass through the spray pattern.

Fixed fog teeth having rounded faces have also been used in place of the teeth with flat faces and the teeth have been molded integrally into the protective rubber bumper commonly mounted on the discharge end of a fire hose nozzle. The spray pattern from such a structure provides a conical row of small jets from the water passing between teeth inside of which is a narrower conical spray pattern from the rounded faces of the teeth. The fog spray from the inner pattern fills the previously hollow center of the spray pattern and eliminates the vacuum effect of the previous spray patterns. However, the outer spray pattern remains poor due to the thin nature of the spray and the gaps between the jets. A double row of fixed teeth have been used, with the inner row positioned opposite the gaps between the teeth in the outer row. The pattern which is produced does not close the objectionable gaps in the spray pattern caused by the outer row of teeth.

OBJECTS OF INVENTION

It is an object of the present invention to overcome the objectionable features of the prior art fog producing nozzles and to provide a peripheral jet-type fire hose nozzle which provides a more uniform spray pattern having a wider angle of divergence.

It is a further object of the present invention to provide a peripheral jet-type fire fighting nozzle which provides a uniformly dispersed fully filled conical spray pattern.

It is also an object of the present invention to provide a peripheral jet-type fire hose nozzle which produces a conical spray pattern free of circumferential gaps in the outer surface thereof.

It is still another object of the invention to provide a peripheral jet-type fire hose nozzle which produces a conical spray pattern having a large angle of divergence.

Other objects of the present invention will be apparent to one skilled in the art from the following detailed description and claims when read in conjunction with the accompanying drawings.

DRAWING FIGURES

Figures 1, 2:
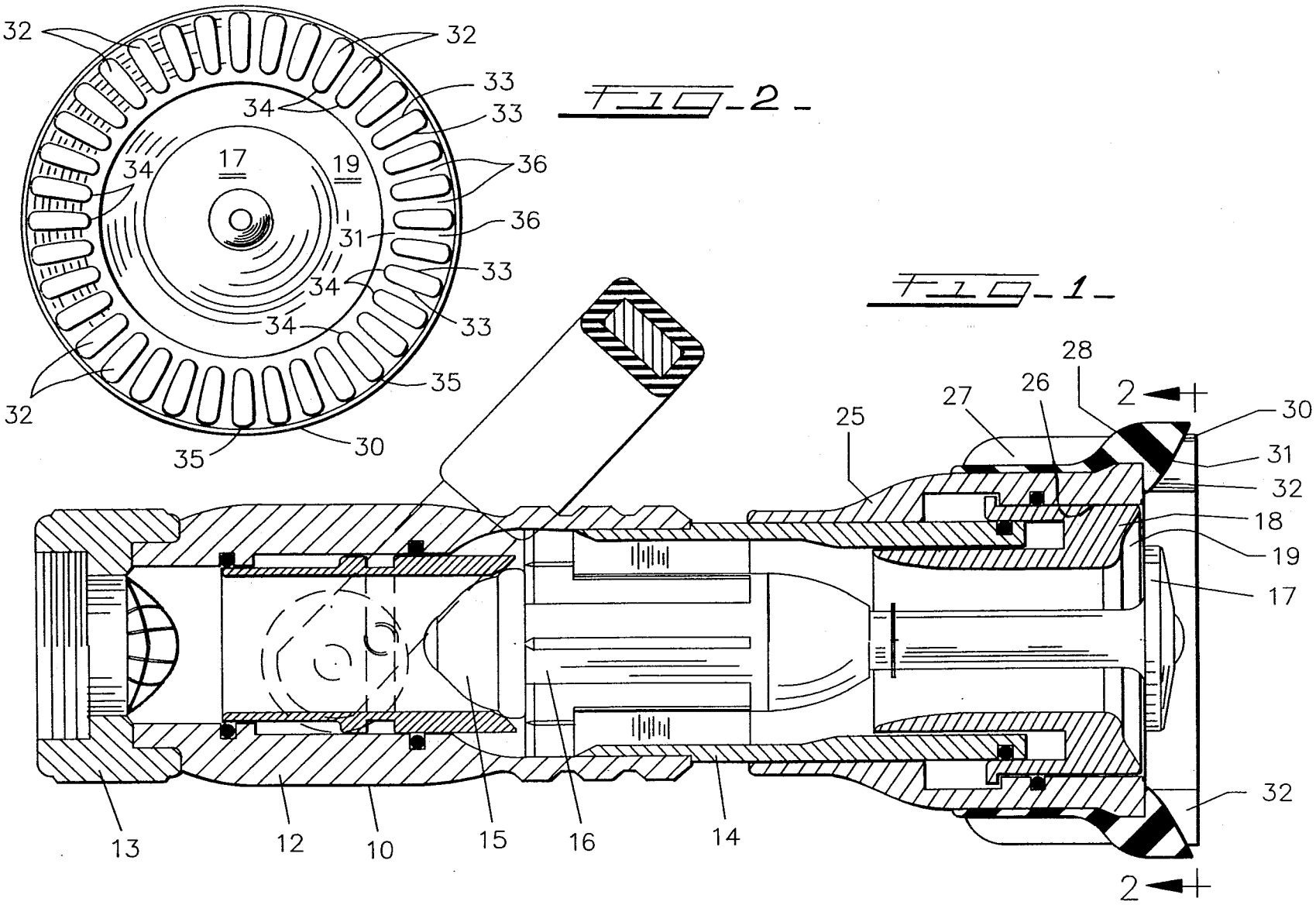
FIG. 1 is a vertical sectional view of a peripheral jet fire hose nozzle having a stream shaper sleeve embodying the present invention mounted on the discharge end of the nozzle.
FIG. 2 is an end elevational view taken along the line of 2—2 of FIG. 1.
Figure 5:
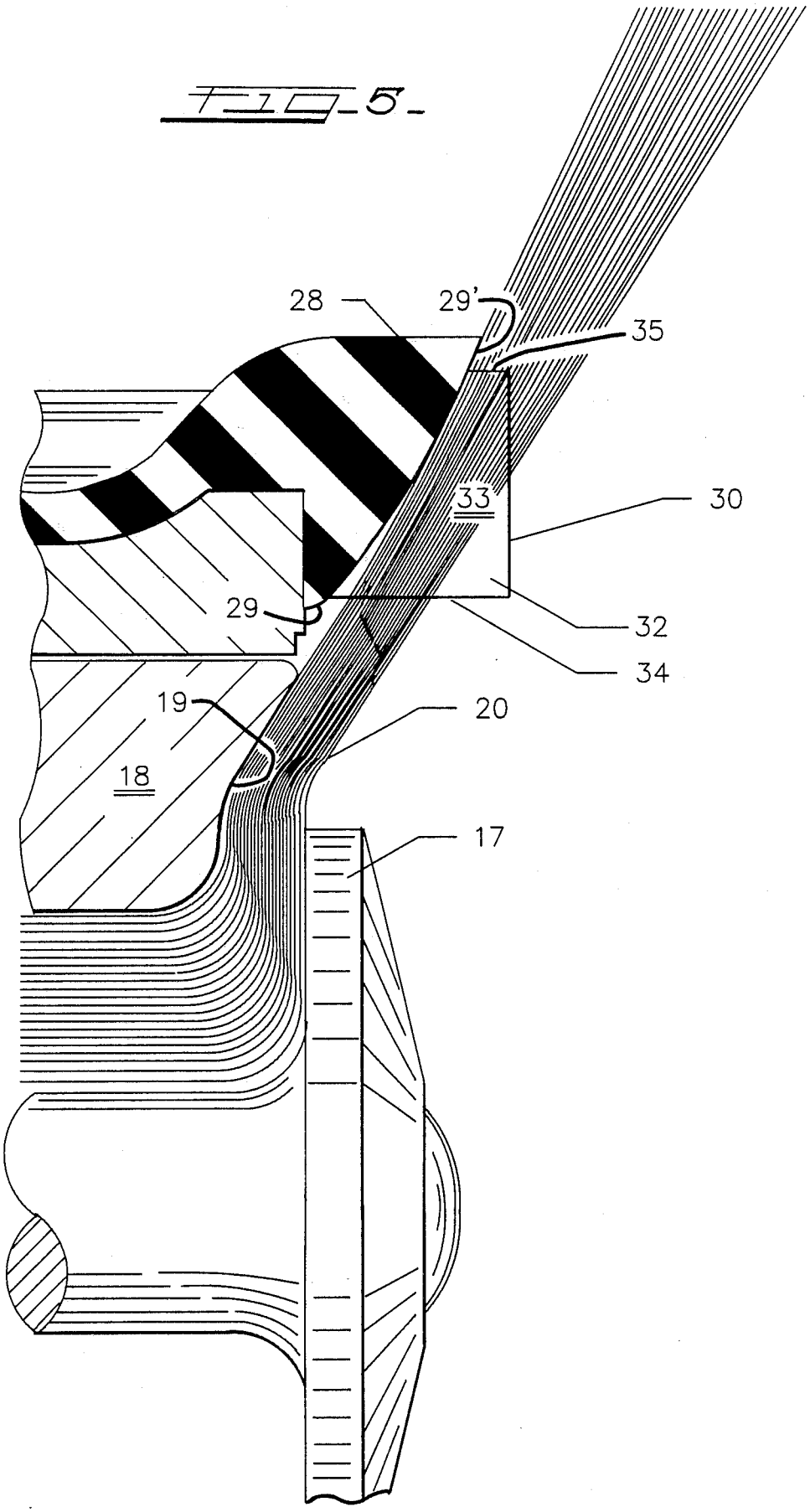
Figure 6:
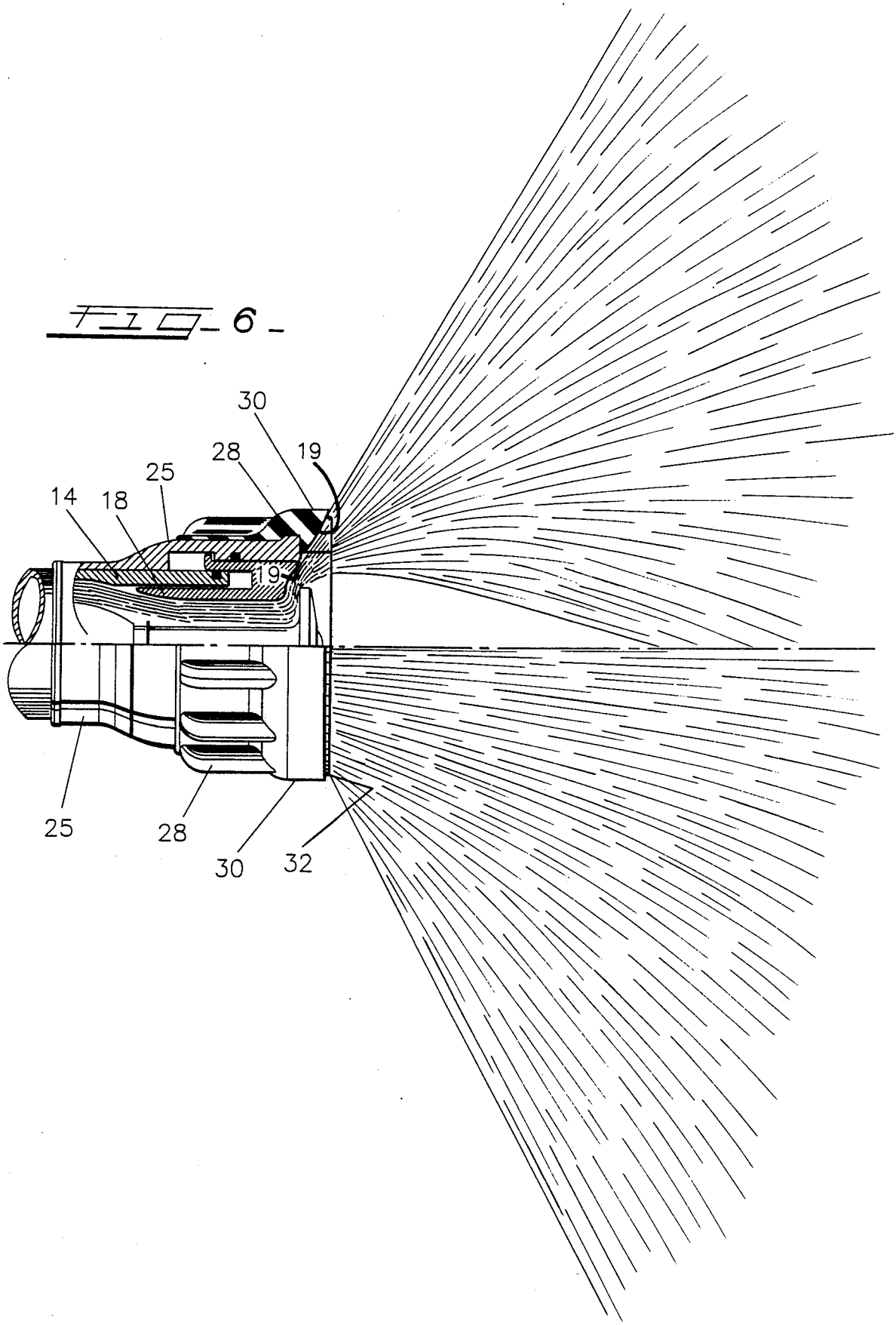

FIG. 5 is a fragmentary enlarged vertical sectional view of the stream shaper sleeve and nozzle showing the impingement of a liquid stream on the axially extending rounded inner end and adjacent lateral surfaces of one of the fog teeth in the shaper sleeve of FIG. 1; and FIG. 6 is a fragmentary schematic vertical sectional view partially in elevation of the fog nozzle of FIG. 1 and the improved conical fog spray pattern produced by the nozzle.

SUMMARY OF INVENTION

The foregoing objects of the present invention can be achieved by providing in a peripheral jet fire hose nozzle a stream shaper sleeve having a contoured end face and a plurality of spaced fog producing teeth having rounded end surfaces disposed about the circumference of the sleeve and preferably with elongated lateral convex surfaces defining convergent-divergent waterways between adjacent fog teeth. The conical spray pattern produced by the fire hose nozzle of the present invention is the combined result of an inner spray pattern comprising a substantially filled inner fog cone produced by the action of a stream of water which has been deflected laterally by an axially disposed baffle impinging upon the rounded end faces of a single row of fog teeth uniformly spaced about the circumference of the shaper sleeve and an outer spray pattern comprising a divergent hollow conical spray pattern having an interior included angle which coincides with the outer included angle of the inner conical spray pattern. The resulting spray pattern is a single substantially fully filled dispersed fog cone having a wide angle of divergence free of gaps around its circumference.

The divergence of the outer spray pattern relative to the longitudinal axis of the nozzle is produced by the contour of the surface of the front face of the stream shaper sleeve. The front face of the shaper sleeve has a forwardly and outwardly inclination with a generally convex curvature. The radius of curvature of the face is such that the stream of water which issues from the end of the fire hose nozzle adheres to the convex surface of the face and is bent laterally as a result of the Coanda effect. The water which contacts and is closely adjacent to the convex surface of the face is bent to a substantially larger angle of divergence than the angle which the stream forms with the longitudinal axis of the nozzle as it passes across the guide face at the discharge end of the nozzle. The water in the stream spaced substantially from the convex surface follows the trajectory which it has as it passes across the guide face. In general, the water in the stream is bent outwardly by the convex surface on the face of the sleeve due to the Coanda effect in proportion to the distance from the convex surface.

The stream forming the outer spray pattern is uniformly distributed about the circumference of the shaper stream as a continuous spray pattern even though there is a row of fog teeth in the path of the peripheral stream of water issuing from the orifice of the nozzle. In the preferred form of the invention the uniform distribution of the water is the result of providing preferably a convex curvature to the axially extending lateral surfaces of the circumferentially spaced fog teeth. The lateral surfaces of the fog teeth are so shaped as to create a narrow waterway between two adjacent teeth and form a waterway having preferably a narrow entryway and preferably forming a convergent-divergent channel. The narrow or short convergent portion of the channel at the entry end of the waterway causes water passing through the channel to adhere to the diverging axially extending sides of the fog teeth without separating at the boundary layer. The remaining portion of the waterway then becomes divergent due to the convex curvature of the vertically extending lateral surface of the teeth and the water adjacent the lateral surfaces follows the profile of the convex surfaces. The water in the stream mid-way between the convex lateral surfaces does not have its trajectory altered, while water at any intermediate position will be bent laterally proportional to the distance from the convex surfaces. The resulting jet which issues from each waterway will be a divergent jet with the angle of divergence being equal to or greater than the angle between the edges of jets entering the waterway. The curvature and length of the lateral surfaces of the teeth will depend on the size of the nozzle, but in each instance is such that the spray issuing from each waterway overlaps with the spray from each adjacent waterway.

The resulting spray pattern utilizing the combination of (1) a contoured face or end surface of the stream shaper sleeve, and (2) the contoured lateral surfaces of the fog teeth disposed about the circumference of the shaper sleeve results in an outer hollow conical spray having a wide angle of divergence and a uniform distribution of spray around its circumference free of gaps.

Figure 3:
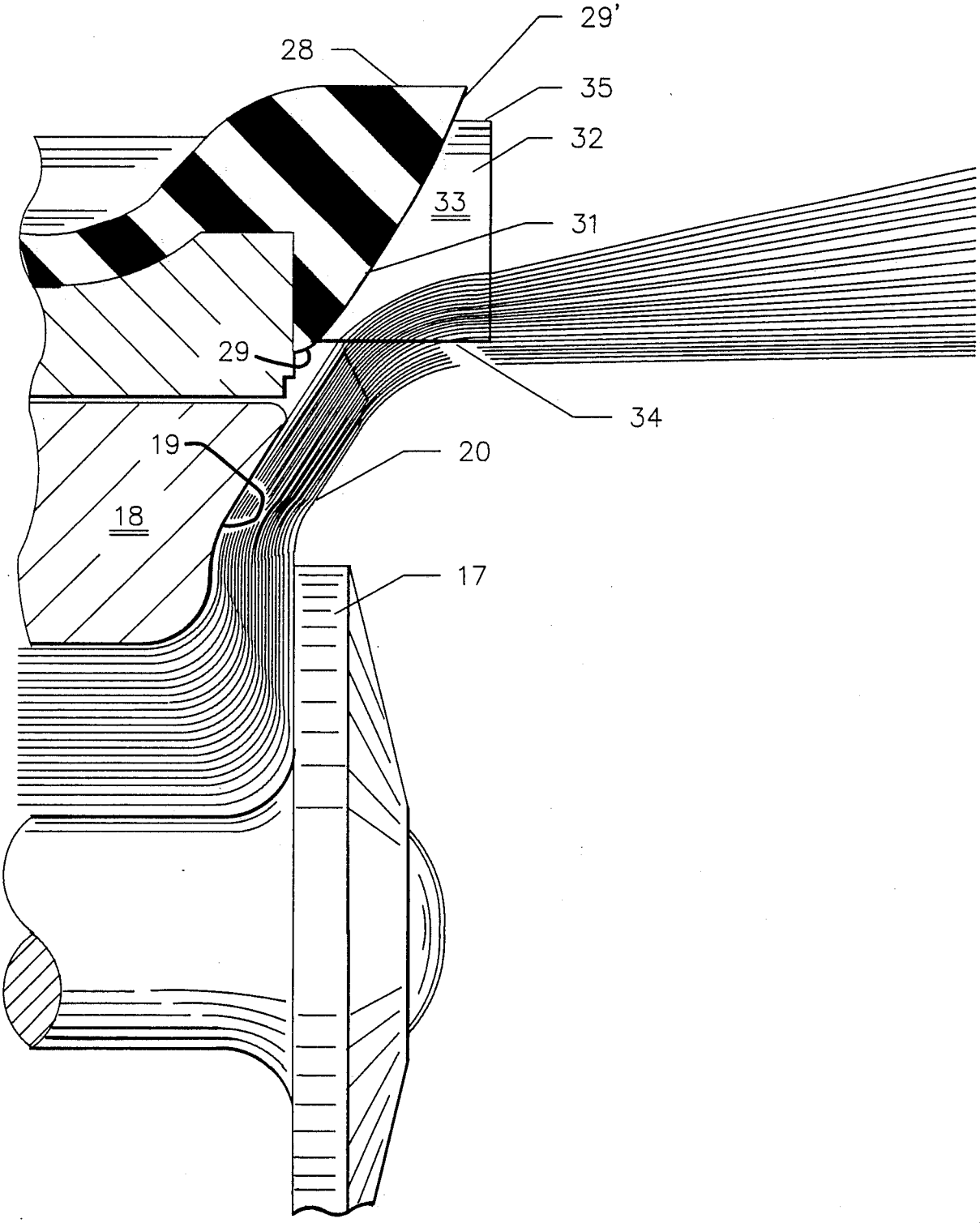
FIG. 3 is a fragmentary enlarged vertical sectional view partially in elevation of a stream shaper sleeve of FIG. 1 showing the flow of liquid over the end face surface thereof.

The inner conical spray pattern is provided by a portion of the stream which issues from the orifice of the nozzle striking the preferred rounded axial surfaces at the inner end of the teeth, as best shown in FIG. 3. The resulting spray pattern substantially fills the hollow outer conical spray pattern (except for a small area immediately adjacent the end of the nozzle), as the included angle of the inner conical spray pattern is made to coincide with the inner included angle of the outer spray pattern. The combination of the inner and outer spray patterns form a single fully filled dispersed fog cone having a wide angle of divergence and a circumference free of gaps.

DETAILED DESCRIPTION

Referring to FIG. 1 of the drawing a fire fighting nozzle assembly 10 having a stream shaper sleeve embodied therein is shown to illustrate a preferred embodiment of the present invention. The nozzle assembly 10 comprises: a tubular receiving section 12 and axially aligned body section 14. The receiver section 12 has a tubular section 13 mounted on the upstream end thereof to facilitate connecting the receiver section with a source of fire extinguishing fluid. A flow control valve assembly 15 is enclosed within the receiver section 12 and body section 14. A pressure control assembly 16 extends axially downstream from the valve assembly 15 and comprises a transverse baffle 17 mounted axially in the downstream end of the nozzle assembly 10. A barrel cone 18 is fixedly secured to the downstream end of the body section 14. The baffle 17 is spaced outwardly a short distance from the guide face 19 of the barrel cone 18 and together form the discharge orifice 20 of the nozzle assembly 10. The guide face 19 of the barrel cone 18 has a laterally and forwardly inclined surface which in the preferred nozzle assembly 10 forms an angle of about 55° with the longitudinal axis of the nozzle assembly 10. The guide face 19 imparts to the stream of fluid a trajectory having an angle of about 55° as it is discharged from the orifice 20.

A generally cylindrical sleeve 25 is mounted on the outer lateral surface of the barrel cone 18, and a rubber bumper 27 is secured to the outer surface of the sleeve 25 with the enlarged outer end 28 thereof extending axially and laterally outwardly beyond the end of the sleeve 25. The enlarged outer or downstream end 28 has incorporated therein a stream shaper sleeve section 30 which comprises the essential features of the present invention. The sleeve 25 is adapted for axial movement relative to the guide face 19. When the downstream end of the sleeve 25 extends forwardly beyond the baffle 17, the inner cylindrical wall 26 of the sleeve 25 guides the water flowing through the nozzle assembly 10 and discharges the water as a narrow stream. When the sleeve 25 is in its fully retracted position, as shown in FIG. 1, with its downstream end coinciding with the end of the barrel cone 18, the nozzle assembly produces the improved fog spray pattern of the present invention.

The ring-like stream shaper sleeve section 30 of the bumper 27 in the preferred embodiment shown in the drawings comprises a laterally and forwardly extending end face 31 having a length of about ½ inch provided with a convex curvature having an angle of entry at its inner or lead-in end 29 of about 45° and an angle of exit adjacent the periphery 29' of the shaper sleeve section 30 of about 65° (See FIG. 3). When the inner end of the end face 31 is disposed opposite the outer edge of the guide face 19, the stream discharged from the orifice 20 has an angle of exit of about 55° as it flows into contact with the end face 31 at about the mid-point thereof and is held in contact with the convex surface 31 over that portion of the convex surface having a tangential angle ranging from about 55° to the exit angle of 65°. The resulting hollow conical spray pattern has a widened angle of divergence due to the stream being diverted from an initial exit angle of about 55° to an angle of about 65°.

Figure 4:
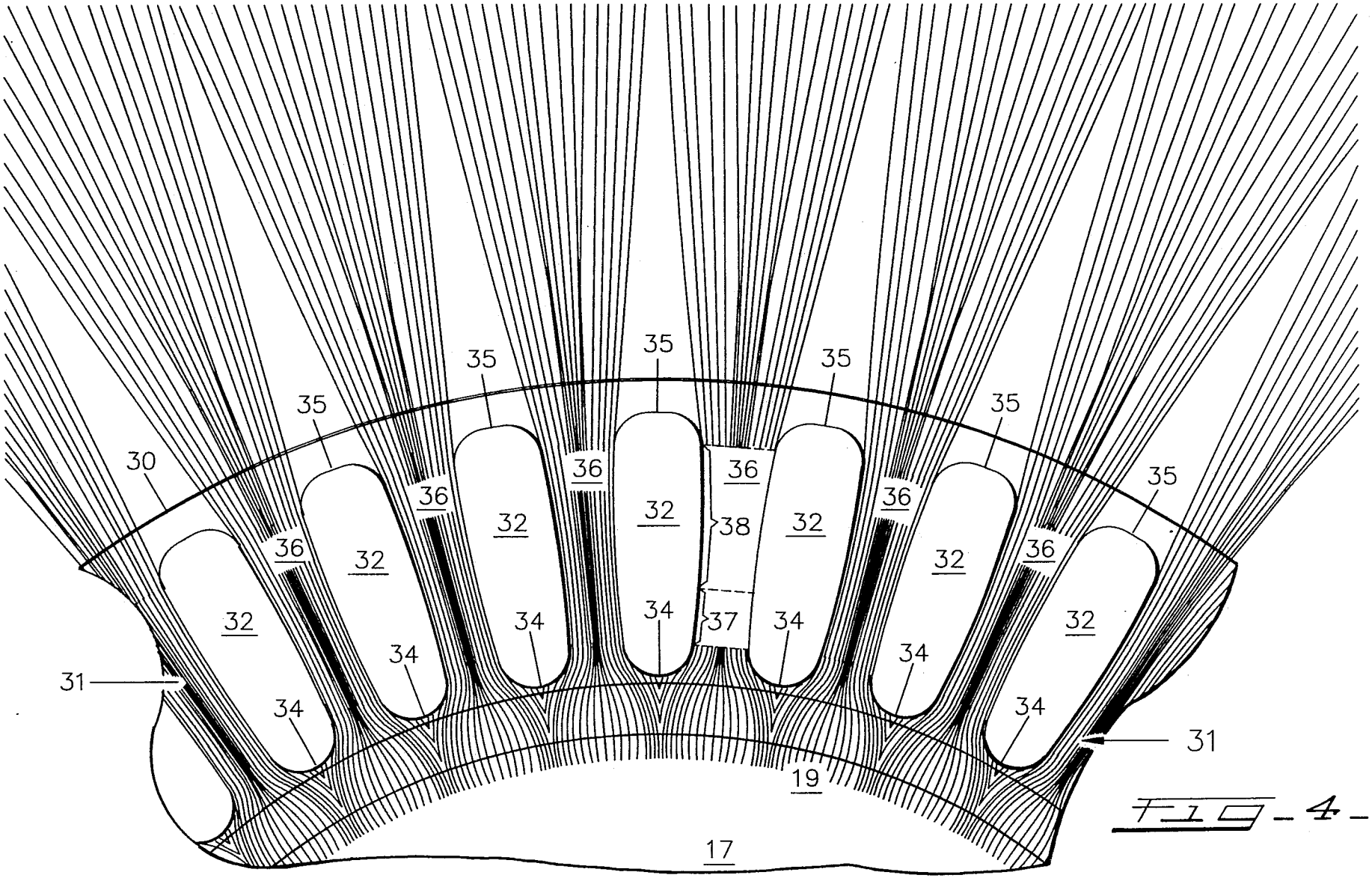
FIG. 4 is a fragmentary enlarged plan view showing the shaper sleeve of FIG. 1 and the convergent-divergent flow of liquid through the waterway defined by the convex curvature of adjacent fog teeth of the shaper sleeve of FIG. 1.

A plurality of longitudinal fog-producing teeth 32 extending axially from the end face 31 of the shaper sleeve 30 are spaced equally about the circumference of the shaper sleeve section 30. As best shown in FIG. 4 each of the teeth 32 has axially extending lateral convex surfaces 33 and preferably has inner and outer rounded end surfaces 34, 35, respectively, such that adjacent teeth provide therebetween a narrow channel or waterway 36. Each waterway 36 has it its entry end a relatively short convergent section 37 followed by a relatively elongated divergent section 38 which is formed by the convex surface of adjacent teeth 32.

The water in the channel or waterway 36 is forced into contact with the lateral wall surfaces at the entry end of the channel formed by the converging lateral surfaces of the teeth 32 and the water is held in contact with the diverging convex surfaces 33. The spacing of the teeth and dimensions of the teeth are controlled so that each stream issuing from each waterway 36 is spread laterally sufficiently to overlap slightly with each adjacent stream and thereby provide a conical spray pattern free of circumferential gaps. The dimensions of the teeth will depend on the number of teeth and the dimensions of the sleeve section 30 of a particular nozzle.

In the preferred embodiment shown in the drawing, the stream shaper section 30 is provided with thirty-six fog-producing teeth 32, the center line of each being spaced 10° and each of the teeth 32 having a height above the end face 31 at the inner edge of about ½ inch and a height at the outer edge of about ⅛ inch. The teeth 32 have a length of about 0.6 inches, a width at the inner end of the converging section of about 0.1 inches, a width at the inner end of the divergent section of about 0.2 inches, and a width of about 0.2 inches at the outer end of the divergent section. The inner rounded end section 39 has a length of about 0.07 inches and the outer rounded end section 40 has a length of about 0.08 inches.

In every instance it is most important that the length, width, and curvature of the teeth 32 are selected so as to provide the required lateral divergence of the streams flowing between teeth 32 to effect the desired spread and overlap of the stream or jets issuing therefrom. The divergence of the stream is dependent on the dimensions of the end surface 31 and the waterway 36 formed by adjacent teeth 32. In the exemplary embodiment shown in the drawing each waterway 36 has an overall length of about 0.6 inches, a width of about 0.25 inches at the entry end, a width of about 0.1 inches at the most restricted portion of the channel, and a width of about 0.3 inches at the outer end of the divergent section of the channel. The rounded outer end section 40 of the teeth 32 has no effect on the configuration of the jets issuing from the waterways. The length of the convergent section 37 of the waterway 36 is about 0.10 inches and the length of the divergent section 38 of the waterway is about 0.36 inches. In the exemplary fog nozzle shown in the drawing figures each jet issuing from each waterway 36 has a divergent angle of about 14°.

The inner spray pattern which fills the outer hollow conical spray pattern is the result of a portion of the stream from the orifice 20 flaring into contact with the rounded front end vertical surface 33 of each of the teeth 32 which deflects the water in many directions as shown in FIG. 5, so as to provide a spray pattern having droplets distributed uniformly throughout a dispersed spray pattern and one which is free of circumferential gaps, as best shown in FIG. 6.

I claim:

1. In a peripheral jet nozzle having upstream and downstream ends, the improvement comprising: a generally cylindrical stream shaper sleeve mounted on the downstream end of said nozzle, said shaper sleeve having an enlarged diameter end section which is adapted to be disposed opposite a baffle member mounted axially on said nozzle adjacent the downstream end thereof such that a stream of liquid is discharged from the said nozzle in a straight line flow conical pattern into contact with the enlarged diameter section of the shaper sleeve, said enlarged diameter section having an end face extending laterally and forwardly with a plurality of fog producing teeth extending axially therefrom having axially extending elongated laternal convex surfaces, said teeth being equally spaced about the circumference of said shaper sleeve so as to define narrow passageways therebetween having entry and exit ends with each said passageway having a short convergent entry portion defined by said convex surfaces and an elongated gradually diverging outlet portion which is wider at the exit end than at the entry end, and said elongated lateral convex surfaces adapted to draw liquid flowing through each said passageway into contact therewith along the length of said lateral convex surfaces to form a divergent spray pattern which overlaps the divergent spray pattern issuing from adjacent passageways; thereby eliminating circumferential gaps in an outer hollow conical spray pattern.

2. A nozzle as in claim 1, wherein said end face of said shaper sleeve has a convex surface with innermost and outermost sections and said innermost section forming an angle with the longitudinal axis of the nozzle not greater than the angle at which the said stream is discharged from said nozzle and said outermost section forming an angle with said longitudinal axis greater than the angle at which said stream is discharged from said nozzle; whereby the liquid in said stream traveling in said straight line flow conical pattern from said nozzle flows into contact with said convex surface of said end face and remains in contact with said convex surface until discharged as a conical spray pattern having a wider angle of divergence than said straight line flow conical pattern.

3. A nozzle as in claim 1, wherein said fog producing teeth have axially extending rounded end surfaces such that liquid in the stream discharged from the nozzle impinging on the said axially extending surfaces of said teeth is deflected forwardly in many directions and forms a conical inner spray pattern which fills the said hollow outer conical spray pattern.

4. In a peripheral jet nozzle having upstream and downstream ends, the improvement comprising, a generally cylindrical stream shaper sleeve having inner and outer sections mounted on the downstream end of said nozzle, said shaper sleeve outer end having an enlarged diameter section which is adapted to be disposed opposite a baffle member mounted axially in said nozzle adjacent the downstream end of said nozzle which discharges a stream of liquid from said nozzle in a straight line flow conical pattern into contact with the enlarged diameter section of the shaper sleeve, said enlarged diameter section having an end face extending laterally and forwardly with a convex surface with a small angular divergence and having innermost and outermost sections with said innermost section forming an angle with the longitudinal axis of the nozzle not exceeding the angle at which the stream is discharged from the nozzle, and said outermost section of said convex surface forming an angle with the longitudinal axis of the nozzle greater than the angle at which the stream is discharged from the nozzle in said straight line flow; whereby liquid from the stream is drawn into and maintained in contact with said convex surface of the end face to form a hollow outer conical spray pattern with a wider angle of divergence than said straight line flow conical pattern.

5. A nozzle as in claim 4, wherein said enlarged diameter section is provided with a plurality of equally circumferentially spaced axially extending fog producing teeth having rounded inner and outer end surfaces and axially extending elongated lateral convex surfaces such that liquid in the stream discharged from the nozzle impinging on the axially extending surfaces of said teeth is deflected forwardly in many directions and forms a conical inner spray pattern which fills the said hollow outer conical spray pattern.

6. A nozzle as in claim 4, wherein said end face of the enlarged diameter section has extending axially therefrom a plurality of fog producing teeth having axially extending elongated lateral convex surfaces, and said teeth being equally spaced about the circumference of said shaper sleeve so as to define narrow passageways with entry and exit ends between adjacent teeth with each said passageway having a short convergent entry portion defined by said convex surfaces and an elongated gradually diverging exit portion which is wider at the exit end than at the entry end; whereby liquid from said stream flowing over said convex surfaces of the teeth is drawn into contact with and remains in contact with said convex surfaces to form an outer conical spray pattern having a wide angle of divergence and a circumference free of gaps.

7. In a peripheral jet nozzle having upstream and downstream ends, the improvement comprising: a generally cylindrical stream shaper sleeve mounted on the downstream end of said nozzle, said shaper sleeve having an enlarged diameter section which is adapted to be disposed opposite a baffle member mounted axially adjacent the downstream end of said nozzle such that a stream of liquid is discharged from said nozzle in a straight line flow conical pattern into contact with the enlarged diameter section of the shaper sleeve, said enlarged diameter section having an end face extending laterally and forwardly with a convex surface having innermost and outermost sections, said innermost section of said convex surface forming an angle with the longitudinal axis of the nozzle not exceeding the angle at which the stream is discharged from the nozzle and said outermost section of said convex surface forming an angle greater than the angle at which the stream is discharged from said nozzle, said end face having extending axially therefrom a plurality of fog producing teeth having axially extending elongated lateral convex surfaces, and said teeth being equally spaced about the circumference of said shaper sleeve so as to define narrow passageways with entry and exit ends between adjacent teeth with each said waterway having a short convergent entry portion defined by said convex surfaces and an elongated gradually diverging outer portion which is wider at the exit end than at the entry end whereby liquid from said stream flowing over said convex surfaces is drawn into contact and remains in contact with said gradually diverging outer portion of said convex surfaces until discharged from each said passageway as a divergent spray pattern which overlaps the divergent spray pattern issuing from adjacent passageways; and forms an outer conical spray pattern having a wider angle of divergence than said straight line flow conical pattern and a circumference free of gaps.

8. A nozzle as in claim 7, wherein said fog producing teeth have rounded end surfaces such that liquid in the stream discharged from the nozzle impinging on the axially extending surfaces of said teeth is deflected forwardly in many directions and forms a conical inner spray pattern which fills the said hollow outer conical spray pattern.

9. In a peripheral jet nozzle having upstream and downstream ends with a generally cylindrical stream shaper sleeve mounted on the downstream end of said nozzle, said shaper sleeve having an enlarged diameter outer end section provided with a convex end face extending laterally and forwardly adapted to be disposed opposite a baffle member mounted axially on said nozzle adjacent the downstream end thereof such that a stream of liquid issuing from said nozzle contacts said end face and forms a hollow outer conical spray pattern, said end face having extending axially therefrom a plurality of fog producing teeth equally spaced about the circumference of said end face, said teeth having axially extending elongated lateral convex surfaces which define passageways therebetween, each said passageway having a short convergent entry portion defined by said convex surfaces, and said teeth having axially extending rounded inner ends such that said stream of liquid issuing from said nozzle impinges on the axially extending surfaces of said teeth and is deflected forwardly in many directions to form an inner conical spray patterns which fills said hollow outer conical spray pattern.

* * * * *